US005537711A

United States Patent [19]

Tseng

[11] Patent Number: 5,537,711

[45] Date of Patent: Jul. 23, 1996

[54] ELECTRIC BOARD CLEANER

[76] Inventor: Yu-Che Tseng, 374, Er Hang Tsun, Ren De Hsiang, Tainan, Shien, Taiwan

[21] Appl. No.: 435,999

[22] Filed: May 5, 1995

[51] Int. Cl.[6] ..... A47L 5/24

[52] U.S. Cl. ..... 15/344; 15/347; 15/398; 15/410

[58] Field of Search ..... 15/344, 347, 412, 15/98, 102, 339, 400, 410, 419.1, 416, 417, 422, 398

[56] References Cited

U.S. PATENT DOCUMENTS

| | | | |
|---|---|---|---|
| 1,801,620 | 4/1931 | Bettman | 15/344 |
| 1,861,261 | 5/1932 | Carson | 15/344 |
| 2,626,418 | 1/1953 | Kelly et al. | 15/344 |
| 2,960,713 | 11/1960 | Wistrand | 15/344 |
| 3,135,986 | 6/1964 | Tolin | 15/422 |
| 3,316,577 | 5/1967 | Kravos | 15/344 |
| 3,914,820 | 10/1975 | Hankel | 15/344 |
| 4,542,557 | 9/1985 | Levine | 15/347 |
| 4,709,875 | 12/1987 | Pugh et al. | 15/347 |
| 4,956,892 | 9/1990 | Fawkes | 15/344 |
| 5,379,483 | 1/1995 | Pino | 15/344 |

FOREIGN PATENT DOCUMENTS

| | | | |
|---|---|---|---|
| 1094799 | 12/1954 | France | 15/344 |
| 1136093 | 12/1956 | France | 15/344 |
| 2573699 | 5/1986 | France | 15/344 |
| 598749 | 10/1959 | Italy | 15/344 |
| 910383 | 11/1962 | United Kingdom | 15/344 |
| 935807 | 9/1963 | United Kingdom | 15/344 |
| 2108434 | 5/1983 | United Kingdom | 15/344 |

*Primary Examiner*—Gary K. Graham

[57] ABSTRACT

An electric board cleaner having a housing formed of two half housings, an absorbing head having a mouth for fixing a cleaning pad, a motor with a fan vertically located in a chamber in the housing, a dust net contained in a dust chamber in the housing, a film horizontally held at a lower end of the absorbing head and able to be tilted open by a sucking force of the fan. The cleaning pad is brought into contact with the surface of a blackboard to rub and wipe chalk powder off by turning on the motor. The dust net is removable for emptying the powder stored therein.

4 Claims, 4 Drawing Sheets

ELECTRIC BOARD CLEANER

BACKGROUND OF THE INVENTION

This invention concerns an electric board cleaner particularly one for wiping chalk powder on a blackboard or powder produced by white board markers and for letting powder sucked in a dust net by means of a motor fixed with a fan and polluting air in a room no longer.

Board cleaners made of velvet are generally used for wiping off chalk powder on a blackboard or powder written with a white board marker, and powder may fly around if a board cleaner has collected too much powder in wiping the blackboard or the white board, easily polluting air in a classroom.

SUMMARY OF THE INVENTION

This invention has a purpose to offer an electric board cleaner simple to operate and to prevent powder from dispersing around in wiping action.

An electric board cleaner in the present invention has a housing formed with two half housings to contain a motor with a fan to draw air mixed with chalk powder wiped by a cleaning pad fitted in a mouth of an absorbing head fitted on the housing, letting chalk powder collected in a case-shaped dust net contained in a compartment in the housing on the motor, which is turned on and off by a switch fixed on an outer side of a grip formed in a lower portion of the housing and one or more batteries placed in a battery case contained in the lower portion of the housing.

DETAILED DESCRIPTION OF THE INVENTION

Figure 1:
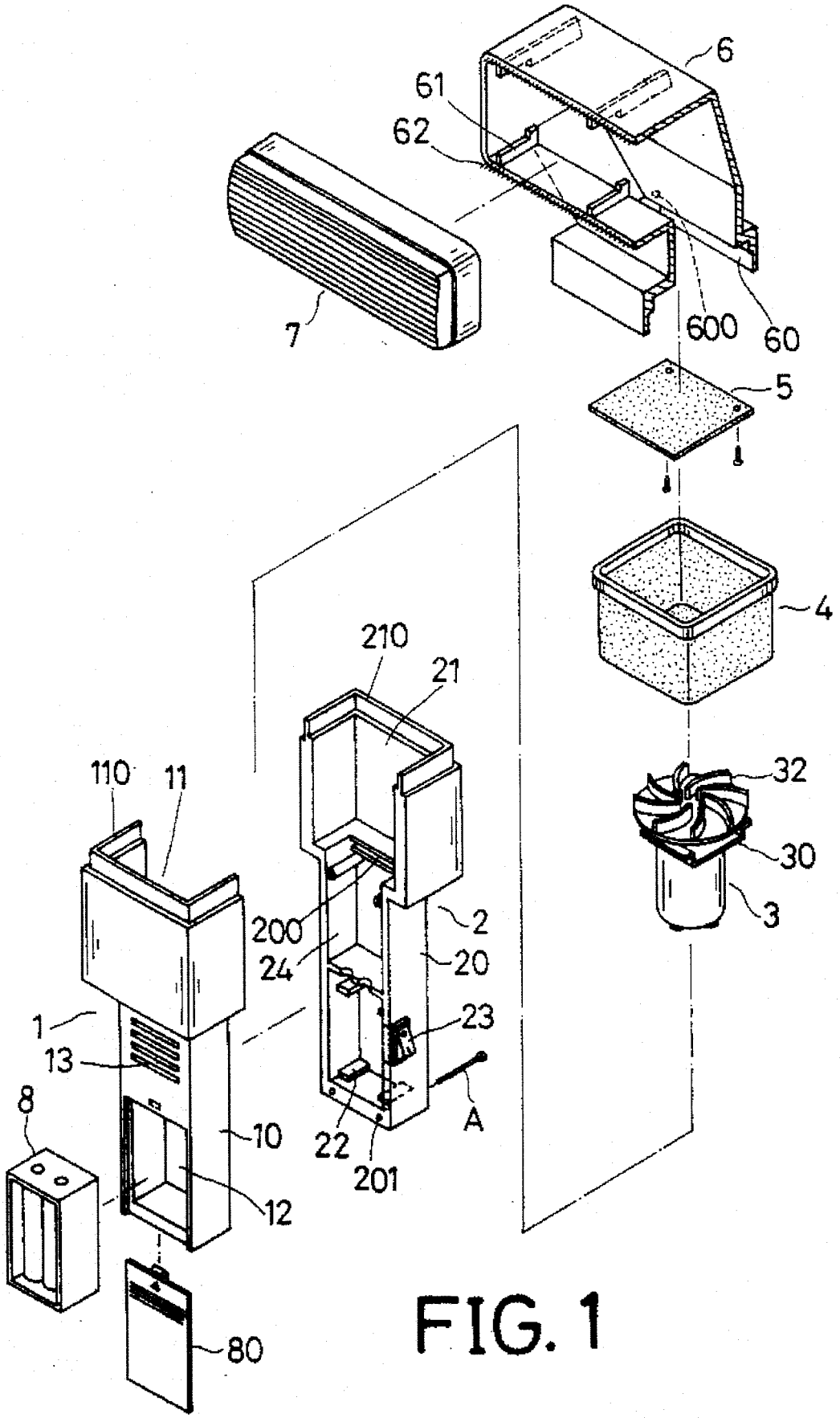
FIG. 1 is an exploded perspective view of an electric board cleaner in the present invention.
Figure 2:
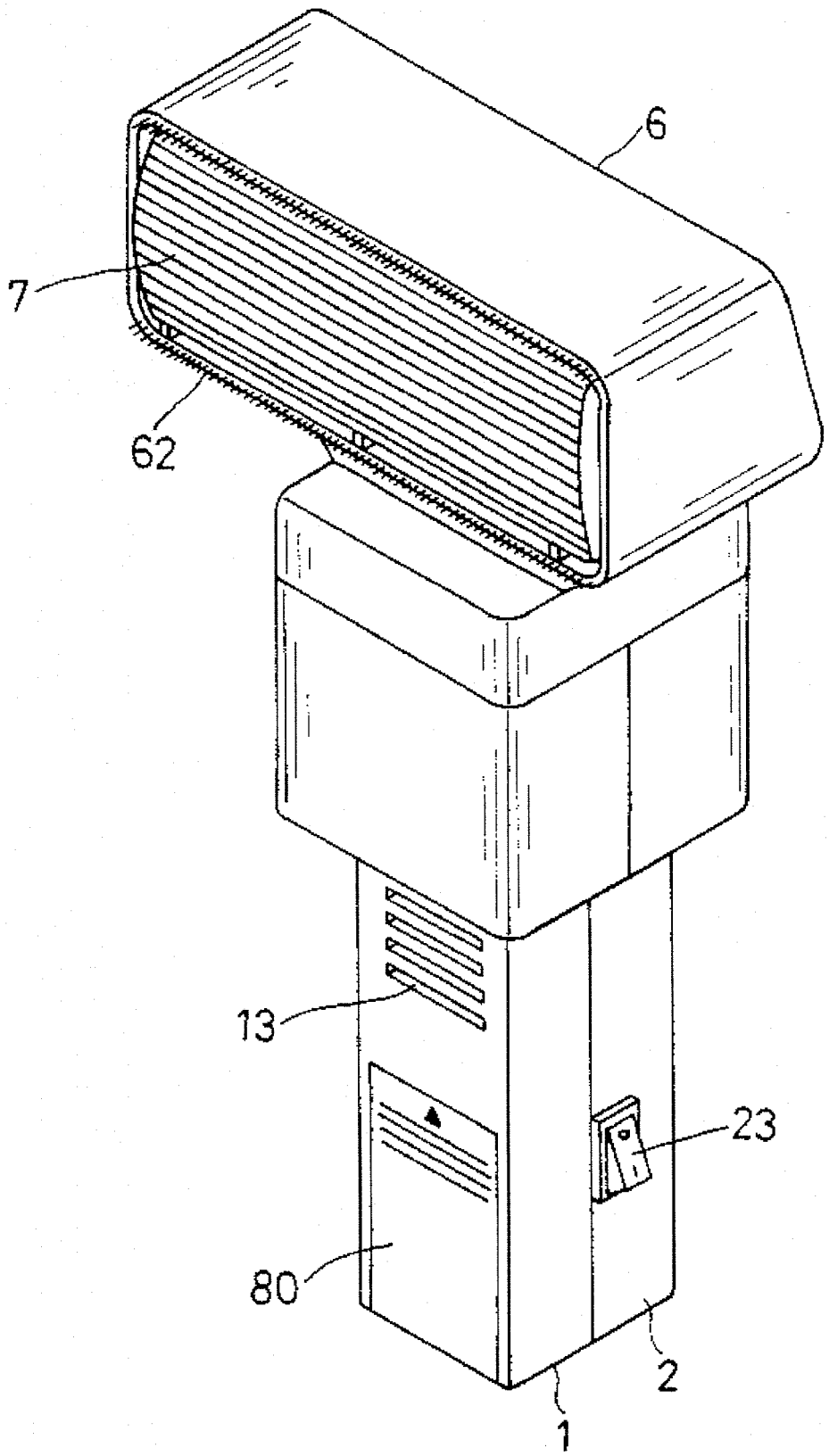
FIG. 2 is a perspective view of the electric board cleaner in the present invention.

An electric board cleaner in the present invention, as shown in FIGS. 1 and 2, comprises two half housings 1, 2, a motor 3, a dust net 4, a film 5, an absorbing head 6, a cleaning pad 7, and a battery case 8 combined together.

The two half housings 1 (a first), 2(a second) are respectively shaped as T, respectively having a grip portion 10, 20, a dust chamber 11, 21, an inner horizontal fitting groove 100, 200 near the top of the grip portion 10, 20, a threaded hole 101, 201 respectively in four lower corners of the grip portion 10, 20, a U-shaped upper short wall 110, 210 on the dust chamber 11, 21, a compartment 12 under the grip portion 10 of the first housing 1, a plurality of heat escaping holes 13 above the compartment 12, a stop block 22. in an inner lower section of the grip portion 20 of the second housing 2, a power switch 23 on the right side of the stop block 22, and a chamber 24 above the stop block 22 and under the dust chamber 21.

The motor 3 is vertically contained in the chamber 24 of the second housing 2 and the corresponding chamber in the first housing 1, having a horizontal position plate 30 near the top, and a shaft 31 fixed with a fan 32.

The dust net 4 is shaped like a case with an open side, contained in the dust chambers 11, 21 of the two housings 1, 2, with its upper circumferential edge sustained by the top edges 110, 210 of the dust chambers 11, 21.

The film 5 is located on the open side of the dust net 4, sustained with screws at one side of a lower edge of the absorbing head 6 so that the film may be pushed open at another side of the lower edge.

The absorbing head 6 has a short circumferential wall 60 at the bottom, two threaded holes 600, 600 on the short wall 60, a plurality of lateral fitting bars 61 on a bottom wall of a sidewise mouth in an upper portion, and a brushing strip 62 respectively fixed on an vertical edge of an upper and a lower horizontal wall defining the mouth.

The cleaning pad 7 is fitted in the sidwise mouth of the absorbing head 6 for rubbing on the surface of a blackboard or a white board.

The battery case 8 is for receiving one or more batteries therein, fitted in the compartment 12 of the first half housing 1, and having a cap 80 closing an open side.

Figure 3:
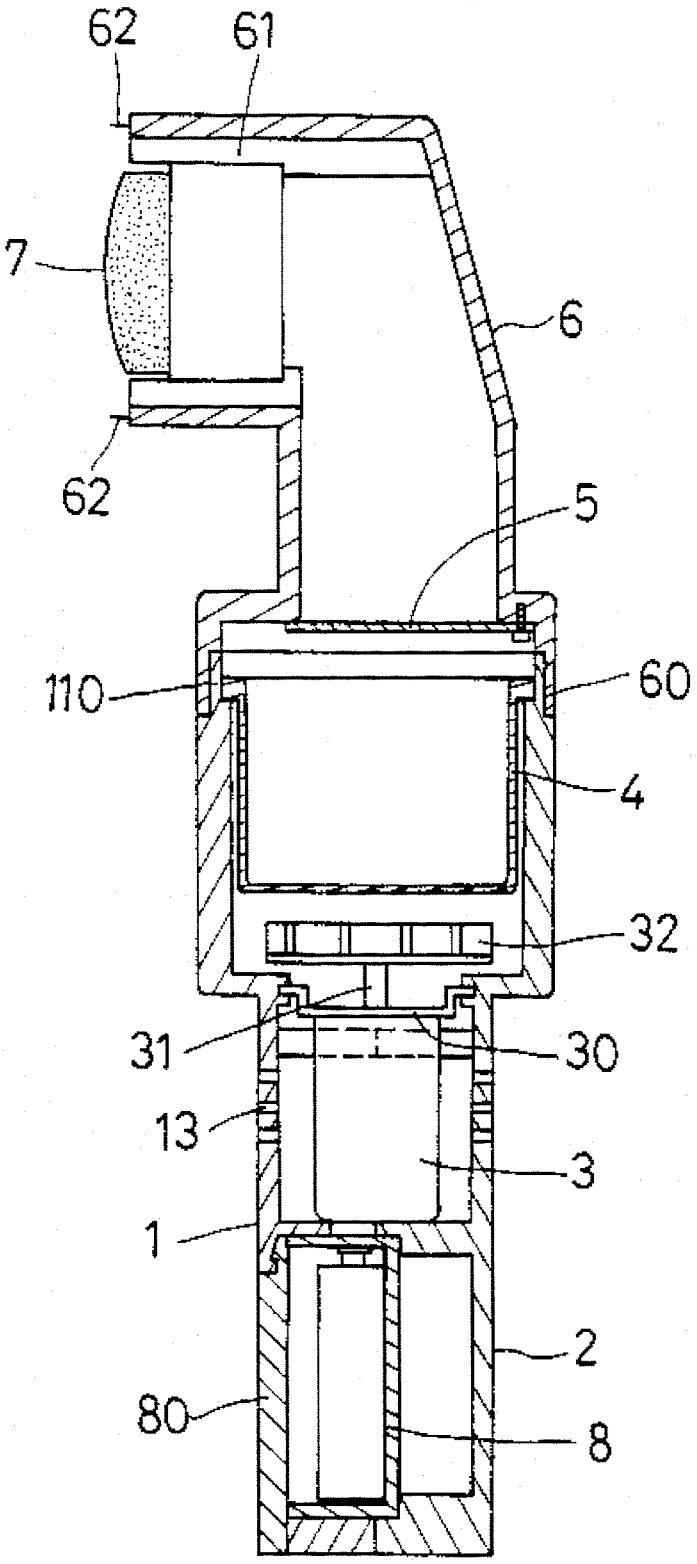
FIG. 3 is a cross-sectional view of the electric board cleaner in the present invention.

In assembling, referring to FIG. 3, firstly, the battery case 8 with a battery is inserted in the compartment 12 of the first half housing 1, then the cap 80 is closed on the open side. Next, the position plate 30 of the motor 3 is fitted in the inner groove 200 of the second half housing 2, letting the motor 3 vertically fitted in the chamber 24 of the second half housing 2 and the corresponding chamber of the first half housing 1. Then the two half housings 1, 2 are combined together to form a complete housing, with the inner groove 100 of the first half housing engaging the position plate 30 of the motor 3 and with screws A engaging the four threaded holes 101, 201 to keep the complete housing tightly. After that, the dust net 4 is fitted in the dust chambers 11, 21, with the top of the net 4 engaging with the inner sides of the upper short walls 110, 210 of the two housings 1, 2, and with the film 5 screwed on a lower edge of the absorbing head 6 with screws engaging the threaded holes 600. Finally, the cleaning pad 7 is pushed in the mouth of the absorbing head 6 and on the fitting bars 61, completing assemblage of the board cleaner.

Figure 4:
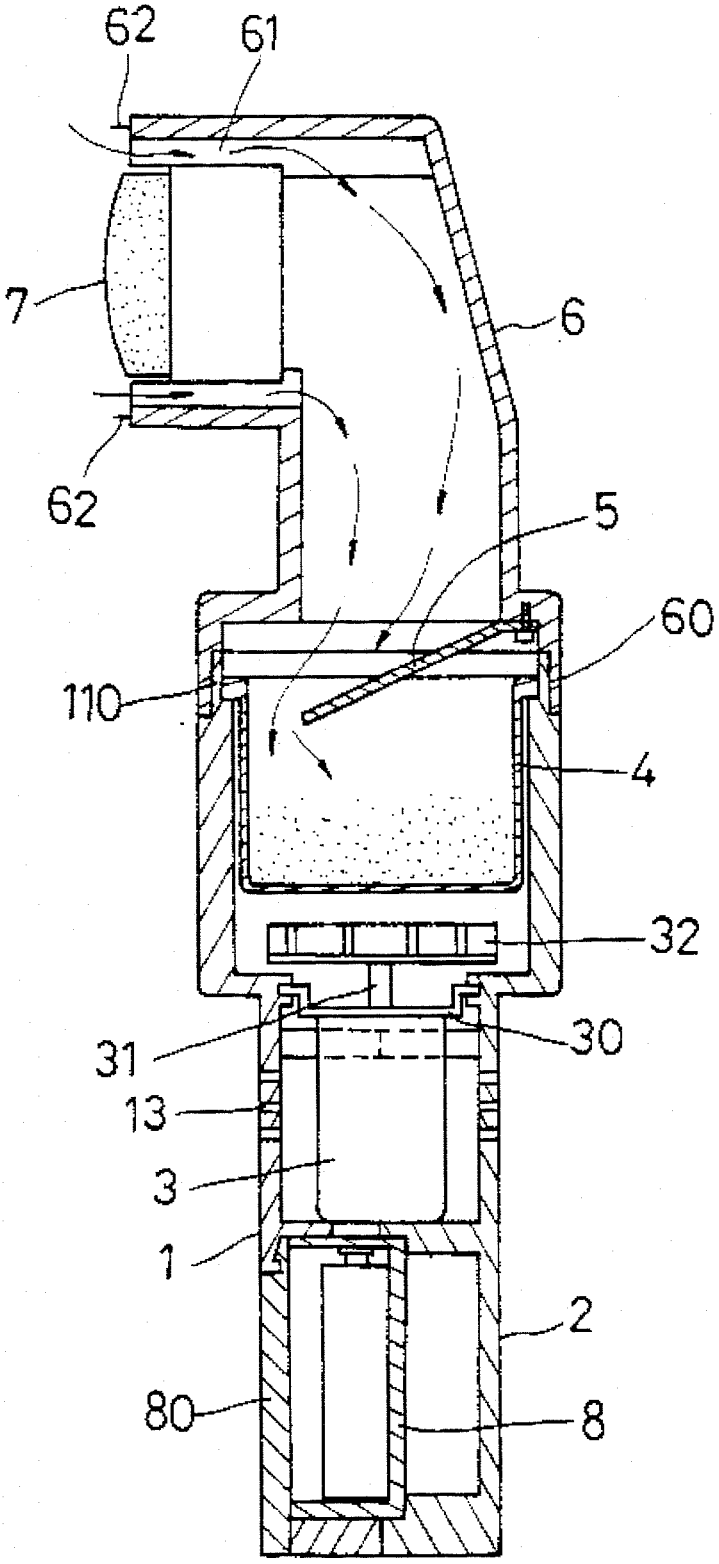
FIG. 4 is a cross-sectional view of the electric board cleaner in the present invention, showing it how to function.

In using, the switch 23 of the grip portion 10 is to be pressed to turn on the power, and then the motor 3 is electrified to rotate the fan 32. Then the cleaning pad 7 of the absorbing head 6 is made to contact the surface of a blackboard by a hand gripping the grips 10, 20, and then moved thereon around to rub off what is written with chalk. The film 5 is to be sucked to tilt by sucking force of the 32, opening the lower opening of the absorbing head 6 so that the wiped chalk is sucked into the dust net 4, as shown by arrow marks in FIG. 4. Besides, chalk powder still remained on the blackboard is wiped by the two brushing pieces 62 of the absorbing head 6 and sucked in the net 4 as well. The air sucked into the net 4 together with the chalk powder will pass through the net 4 and flow out of the heat dispersing holes 13 of the grip 10. Then the air in the room may not be polluted by chalk powder. The dust net 4 can be taken out to empty chalk power in case of the chalk power being full in the net 4.

The board cleaner in the present invention surely has advantages as follows.

1. Chalk power can be immediately sucked into the dust net in rubbing a blackboard, not polluting the air in a room.

2. The two brushing pieces provided on the absorbing head can brush off remaining chalk on a blackboard, and the film under the lower opening of the cleaning head can prevent the chalk powder already sucked in the dust net from flying back through the cleaning head, functioning as a stop valve.

3. Even pupils of a short body can reach a high portion of a blackboard, as it has a long size.

What is claimed is:

1. An electric board cleaner comprising:

a hollow housing having approximately a T shape, said housing having a grip formed in a lower portion, a dust chamber formed in an upper portion, a pair of horizontal grooves provided inside adjacent said dust chamber, and a power switch fixed on an outer side surface of the grip;

a motor attached within and to said housing by means of a position plate fitted into said horizontal grooves, said motor having a shaft with an upper end extending into said dust chamber, said upper end having a fan fixed thereon, said motor being electrically coupled with said switch;

a dust net with an upper open side located within said dust chamber;

a hollow absorbing head with a mouth opening and a lower opening, said mouth opening being elongated defining upper and lower side edges, each side edge including an elongated brushing strip attached thereto, said lower opening having a lower short circumferential wall therearound, said wall engaging around an upper end of said upper portion above said dust chamber for detachably securing said head to said housing, a plurality of lateral fitting bars are provided on said head within said mouth opening;

a flexible film affixed to said head and covering said lower opening, wherein said film closes the lower opening in an unbiased state and is displaced by suction of the fan of the motor when the motor is turned on to allow debris to pass through said head and into the net within said dust chamber;

a cleaning pad located in the mouth opening of the absorbing head and engaging the lateral fitting bars of said absorbing head; and, a battery case removably fitted in the lower portion of said housing, said lower portion having a removable cap to enable removal of said case from said housing, said battery case having at least one battery therein, and said at least one battery being electrically coupled with said switch; whereby said motor is turned on by said power switch to rotate the fan to draw air mixed with chalk powder from outside of the mouth opening of said absorbing head, around the cleaning pad, through the head and past the film, which is biased open by suction force of the fan, and into said dust net, when said cleaning pad contacts a surface of a blackboard and is rubbed thereon to wipe chalk powder.

2. The electric board cleaner as claimed in claim 1, wherein said housing comprises two half housings each having a plurality of threaded holes for screws to attach said two half housings together, and each having a U-shaped upper short wall formed in the upper portion for attachment of the lower end of said absorbing head.

3. The electric board cleaner as claimed in claim 2, wherein; one of said half housings has a stop block in an inner surface of a bottom thereof and the power switch is fixed to said one half housing; and both half housings have a second chamber for receiving said motor therein.

4. The electric board cleaner as claimed in claim 2, wherein said absorbing head lower short circumferential wall fits around said upper short wall of said two half housings.

* * * * *